US011038315B2

(12) United States Patent
Stuart et al.

(10) Patent No.: US 11,038,315 B2
(45) Date of Patent: Jun. 15, 2021

(54) ELECTRICAL CONNECTOR TOOL

(71) Applicant: The Boeing Company, Chicago, IL (US)

(72) Inventors: Mark Alan Stuart, Auburn, WA (US); Brett August Tinius, Puyallup, WA (US); Brian Charles Poggioli, Maple Valley, WA (US)

(73) Assignee: The Boeing Company, Chicago, IL (US)

( * ) Notice: Subject to any disclaimer, the term of this patent is extended or adjusted under 35 U.S.C. 154(b) by 315 days.

(21) Appl. No.: 16/109,205

(22) Filed: Aug. 22, 2018

(65) Prior Publication Data

US 2020/0067254 A1 Feb. 27, 2020

(51) Int. Cl.

| | |
|---|---|
| ***H01R 43/26*** | (2006.01) |
| ***B25B 5/16*** | (2006.01) |
| ***B25B 5/14*** | (2006.01) |
| ***B25B 5/06*** | (2006.01) |

(52) U.S. Cl.
CPC ..... *H01R 43/26* (2013.01); *B25B 5/068* (2013.01); *B25B 5/14* (2013.01); *B25B 5/163* (2013.01)

(58) Field of Classification Search
CPC ..... H01R 41/00; G02B 5/068; G02B 5/14; G02B 5/163
See application file for complete search history.

(56) References Cited

U.S. PATENT DOCUMENTS 7,466,891 B2 * 12/2008 Wagner ..... G02B 6/3802 385/134

* cited by examiner

*Primary Examiner* — Carl J Arbes
(74) *Attorney, Agent, or Firm* — Duft & Bornsen, PC

(57) ABSTRACT

An apparatus configured to assist an operator in connecting electrical connectors. The apparatus includes a first U-shaped cradle and a second U-shaped cradle. Each of the cradles has a contact surface on a front side that is configured to contact a flange on an electrical connector. Each of the cradles also includes a jaw mount configured to mount on a jaw member of a bar clamp.

20 Claims, 10 Drawing Sheets

ELECTRICAL CONNECTOR TOOL

FIELD

This disclosure relates to the field of tools, and more particularly, to tools for assisting operators with connecting electrical connectors.

BACKGROUND

There are various applications where an operator, technician, mechanic, etc., is tasked with plugging a large electrical plug into a large electrical receptacle, such as concerts, amusement parks, manufacturing floors, etc. An operator may have to exert high forces to fully connect the plug into the receptacle. The forces may be so great that operators with low strength capabilities cannot perform these tasks. Also, performing such tasks may expose an operator to Musculoskeletal Disorders (MSDs), such as carpal tunnel syndrome and tendinitis. This adversely affects production and quality of life for the operator.

SUMMARY

Embodiments described herein provide for an electrical connector tool and associated method to assist an operator with connecting electrical connectors, such as large electrical connectors. As an overview, the electrical connector tool includes U-shaped cradles that are mounted on jaw members of a bar clamp. One of the electrical connectors (e.g., a male connector) is inserted (i.e., transversely) through the top of one of the cradles, and a front side of the cradle abuts a flange on the electrical connector. The other electrical connector (e.g., a female connector) is inserted through the top of the other cradle, and a front side of the other cradle abuts a flange on the other electrical connector. As the bar clamp draws the cradles together, the electrical connectors are squeezed between the cradles until they are fully connected. With this electrical connector tool, the amount of force exerted by an operator to connect large electrical connectors is significantly reduced. One technical benefit is that operators will experience less muscle fatigue throughout the workday, and the risk of MSDs is reduced. Another technical benefit is that operators with lower strength capabilities or with only one hand/arm are able to connect large electrical connectors, which can assist employers in complying with the Americans with Disabilities Act (ADA).

One embodiment comprises an apparatus for an electrical connector tool. The apparatus comprises a first U-shaped cradle and a second U-shaped cradle. Each of the first U-shaped cradle and the second U-shaped cradle comprises a contact surface on a front side configured to contact a flange on an electrical connector, and a jaw mount configured to mount on a jaw member of a bar clamp.

In another embodiment, each of the first U-shaped cradle and the second U-shaped cradle comprises a main body member, and a pair of arms that project from a top side of the main body member. The arms are spaced apart by a gap, and are coplanar along the contact surface.

In another embodiment, the arms project in parallel from the top side of the main body member.

In another embodiment, the gap between the arms is dimensioned so that an outer surface of the electrical connector fits between the arms.

In another embodiment, the jaw mount comprises a T-slot formed in the main body member that extends from a bottom side of the main body member toward the top side of the main body member.

In another embodiment, the T-slot includes a base surface disposed at a depth from a back side of the main body member, and the base surface is oriented at an angle to the contact surface.

In another embodiment, the base surface slants from the bottom side of the main body member toward the contact surface at an angle in the range of 3-7 degrees.

In another embodiment, the T-slot is dimensioned to receive a jaw pad on the jaw member with the base surface abutting a pressing face of the jaw pad.

In another embodiment, each of the first U-shaped cradle and the second U-shaped cradle comprises one or more index pins in one or both of the arms that project from the contact surface.

In another embodiment, the index pin(s) projects perpendicularly from the contact surface.

Another embodiment comprises a method of connecting electrical connectors with an electrical connector tool. The method includes mounting a first U-shaped cradle to a first jaw member of a bar clamp, and mounting a second U-shaped cradle to a second jaw member of the bar clamp so that a first contact surface of the first U-shaped cradle faces a second contact surface of the second U-shaped cradle. The method further includes positioning a first electrical connector in the first U-shaped cradle so that the first contact surface of the first U-shaped cradle contacts a first flange on the first electrical connector. The method further includes positioning a second electrical connector in the second U-shaped cradle so that the second contact surface of the second U-shaped cradle contacts a second flange on the second electrical connector. The method further includes moving the second U-shaped cradle toward the first U-shaped cradle via the bar clamp to connect the second electrical connector with the first electrical connector.

In another embodiment, the method includes inserting an index pin(s) that projects from the first contact surface of the first U-shaped cradle through an index hole(s) in the first flange on the first electrical connector, and inserting an index pin(s) that projects from the second contact surface of the second U-shaped cradle through an index hole(s) in the second flange on the second electrical connector.

In another embodiment, the bar clamp comprises a ratcheting bar clamp. The step of moving the second U-shaped cradle toward the first U-shaped cradle comprises squeezing a trigger on a ratcheting handle of the ratcheting bar clamp.

In another embodiment, the method includes fabricating the first U-shaped cradle and the second U-shaped cradle via 3D printing.

Another embodiment comprises an electrical connector tool. The electrical connector tool includes a bar clamp including a fixed jaw member fixedly attached to a slide bar, and a movable jaw member movably attached to the slide bar. The electrical connector tool includes a first U-shaped cradle mounted on the fixed jaw member, and a second U-shaped cradle mounted on the movable jaw member. The first U-shaped cradle has a contact surface configured to contact a flange on a first electrical connector when the first electrical connector is positioned in the first U-shaped cradle. The second U-shaped cradle has a contact surface configured to contact a flange on a second electrical connector when the second electrical connector is positioned in the second U-shaped cradle. The bar clamp further includes a ratcheting handle configured to move the movable jaw member toward the fixed jaw member to compress the first electrical connector and the second electrical connector between the first U-shaped cradle and the second U-shaped cradle.

In another embodiment, the first U-shaped cradle includes one or more index pins that project from the contact surface of the first U-shaped cradle, and are configured to be inserted through one or more index holes in the flange on the first electrical connector. The second U-shaped cradle includes one or more index pins that project from the contact surface of the second U-shaped cradle, and are configured to be inserted through one or more index holes in the flange on the second electrical connector.

In another embodiment, the index pin(s) of the first U-shaped cradle and the index pin(s) of the second U-shaped cradle are cone shaped.

In another embodiment, each of the first U-shaped cradle and the second U-shaped cradle comprises a main body member, and a pair of arms that project in parallel from a top side of the main body member. The arms are spaced apart by a gap, and are coplanar along the contact surface.

In another embodiment, the main body member includes a T-slot that extends from a bottom side of the main body member toward the top side of the main body member. The T-slot is dimensioned to receive a jaw pad on the fixed jaw member or moveable jaw member with a base surface abutting a pressing face of the jaw pad. The base surface of the T-slot is oriented at an angle to the contact surface.

In another embodiment, the base surface slants from the bottom side of the main body member toward the contact surface at an angle in the range of 3-7 degrees.

The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, with reference to the accompanying drawings. The same reference number represents the same element or the same type of element on all drawings.

DETAILED DESCRIPTION

The figures and the following description illustrate specific exemplary embodiments. It will be appreciated that those skilled in the art will be able to devise various arrangements that, although not explicitly described or shown herein, embody the principles described herein and are included within the contemplated scope of the claims that follow this description. Furthermore, any examples described herein are intended to aid in understanding the principles of the disclosure, and are to be construed as being without limitation. As a result, this disclosure is not limited to the specific embodiments or examples described below, but by the claims and their equivalents.

Figure 1:
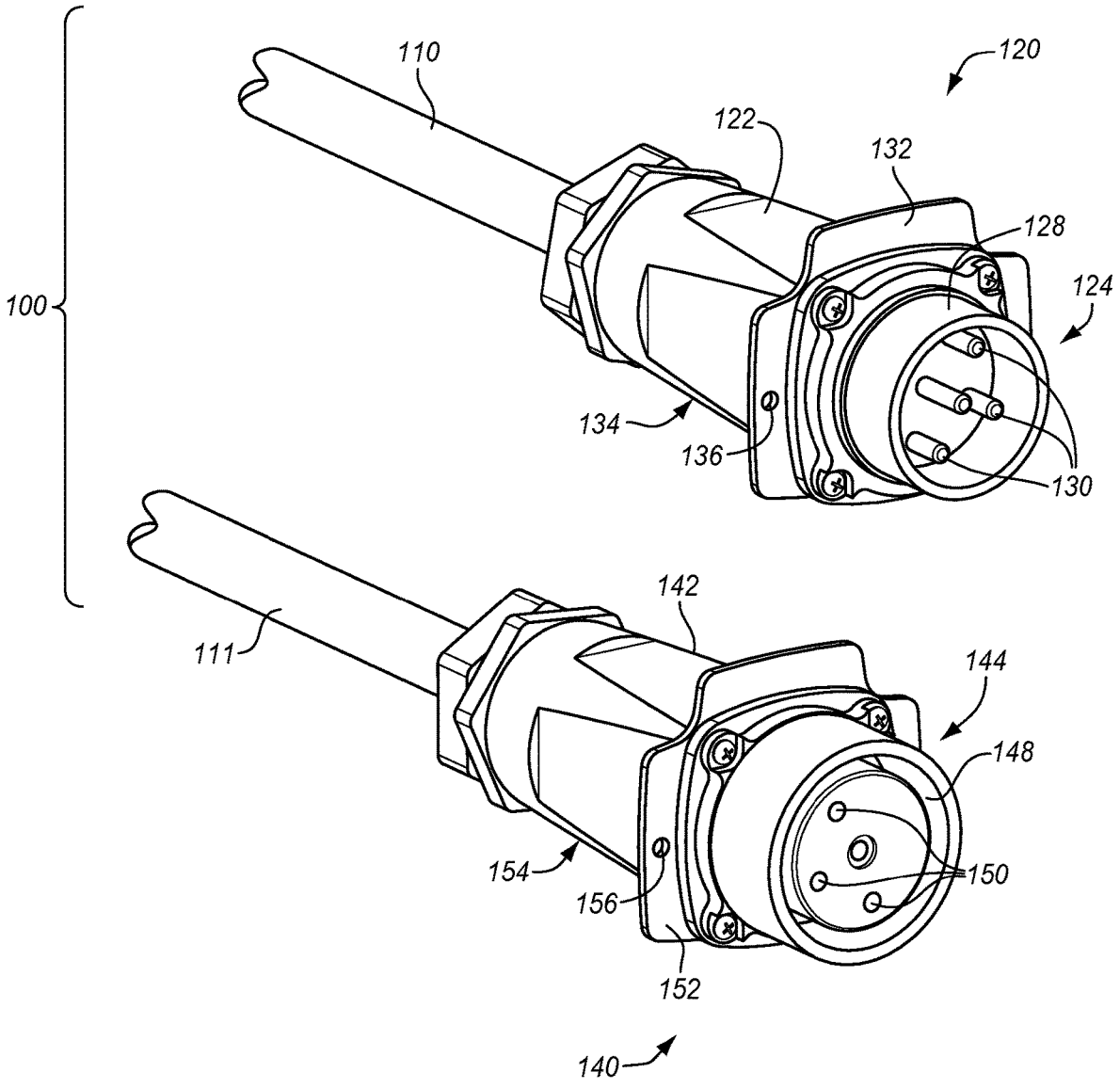
FIG. 1 illustrates a plug and connector assembly.

FIG. 1 illustrates a plug and connector assembly 100. Assembly 100 includes an electrical cord 110 with an electrical connector 120 installed at one end of electrical cord 110. Assembly 100 also includes an electrical cord 111 with an electrical connector 140 installed at one end of electrical cord 111. Electrical connector 120 is configured to mate or join with electrical connector 140 to create an electric circuit.

Electrical connector 120 includes a handle 122 (or housing) connected at one end to electrical cord 110, and connected at the other end to a male-ended plug 124. Handle 122 is substantially hollow to provide a passageway for the conductors (not shown) of electrical cord 110 to connect with plug 124. Plug 124 includes a sleeve 128, and one or more (male) pins 130 (or terminals) that electrically connect with the conductors of electrical cord 110. Electrical connector 120 also includes a flange 132 that projects radially from a periphery or outer surface 134 of electrical connector 120. Outer surface 134 of electrical connector 120 may generally have a cylindrical shape or profile due to the shape of handle 122, plug 124, sleeve 128, etc., although other shapes are considered herein. Flange 132 may project around the circumference of outer surface 134, or a portion of the circumference. Flange 132 may be molded with handle 122 or plug 124, or may be an accessory attached between handle 122 and plug 124, such as a draw plate. Flange 132 may be formed from a rigid material, such as plastic, and may include one or more index holes 136 as shown in FIG. 1.

Electrical connector 140 includes a handle 142 connected at one end to electrical cord 111, and connected at the other end to a female-ended receptacle 144 (or socket). Handle 142 is substantially hollow to provide a passageway for the conductors of electrical cord 111 to connect with receptacle 144. Receptacle 144 includes an annular cavity 148 that accommodates sleeve 128 of plug 124, and one or more (female) terminals 150 that electrically connect with the conductors of electrical cord 111. Terminals 150 are configured to mate with pins 130 of plug 124. Electrical connector 140 also includes a flange 152 that projects radially from a periphery or outer surface 154 of electrical connector 140. Outer surface 154 of electrical connector 140 may generally have a cylindrical shape or profile due to the shape of handle 142 and receptacle 144, although other shapes are considered herein. Flange 152 may project around the circumference of outer surface 154, or a portion of the circumference. Flange 152 may be molded with handle 142 or receptacle 144, or may be an accessory attached between handle 142 and receptacle 144, such as a draw plate. Flange 152 may be formed from a rigid material, and may include one or more index holes 156 as shown in FIG. 1.

The characterization of electrical connectors 120/140 in FIG. 1 is one example. However, the pinout, physical construction, size, etc., of electrical connectors 120/140 may vary in other examples.

Electrical connectors 120/140 may represent "large" electrical connectors, which are larger than a typical electrical connector used for 120-volt applications. For example, electrical connectors 120/140 may be rated for 480 volts or more. In large electrical connectors such as this, the contact resistance between the electrical connectors may be high. For instance, the contact resistance between sleeve 128 and annular cavity 148 and/or the contact resistance between pins 130 and terminals 150 may make it difficult for an operator to fully insert plug 124 into receptacle 144. The following embodiments set forth an electrical connector tool and associated method to assist an operator in coupling electrical connectors such as shown in FIG. 1.

Figure 2:
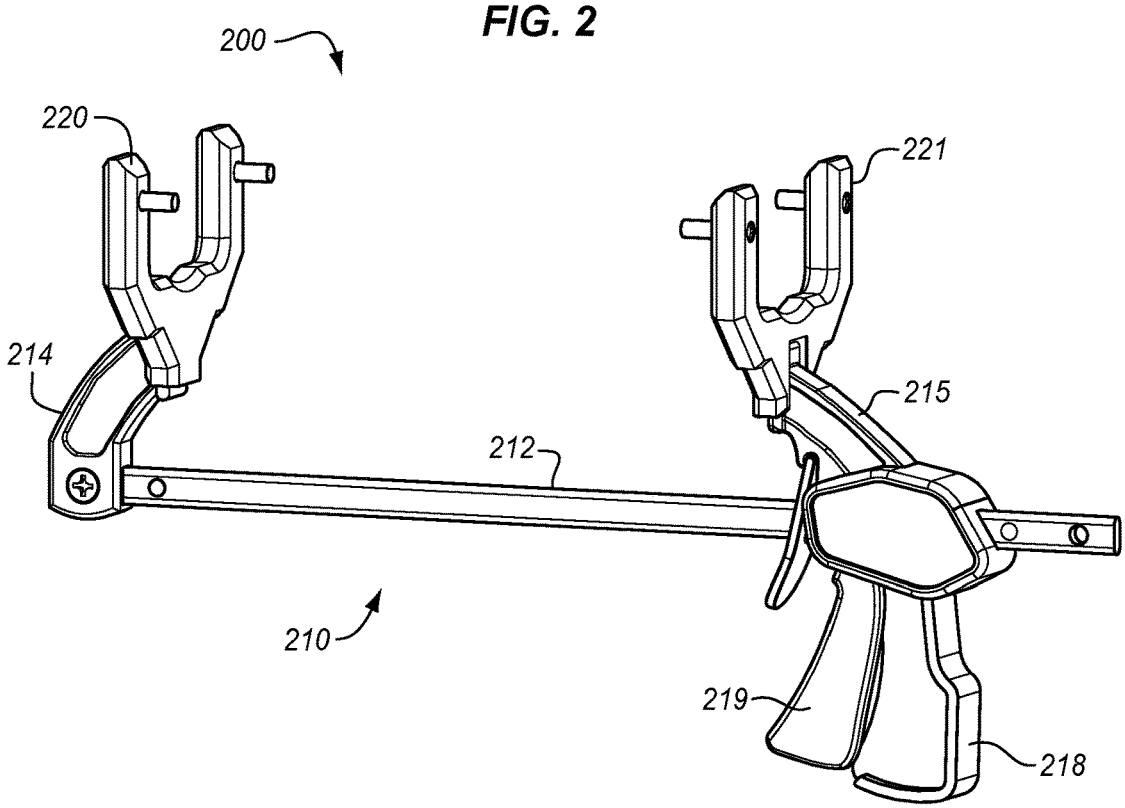
FIGS. 2-3 illustrate an electrical connector tool in an illustrative embodiment.
Figure 3:
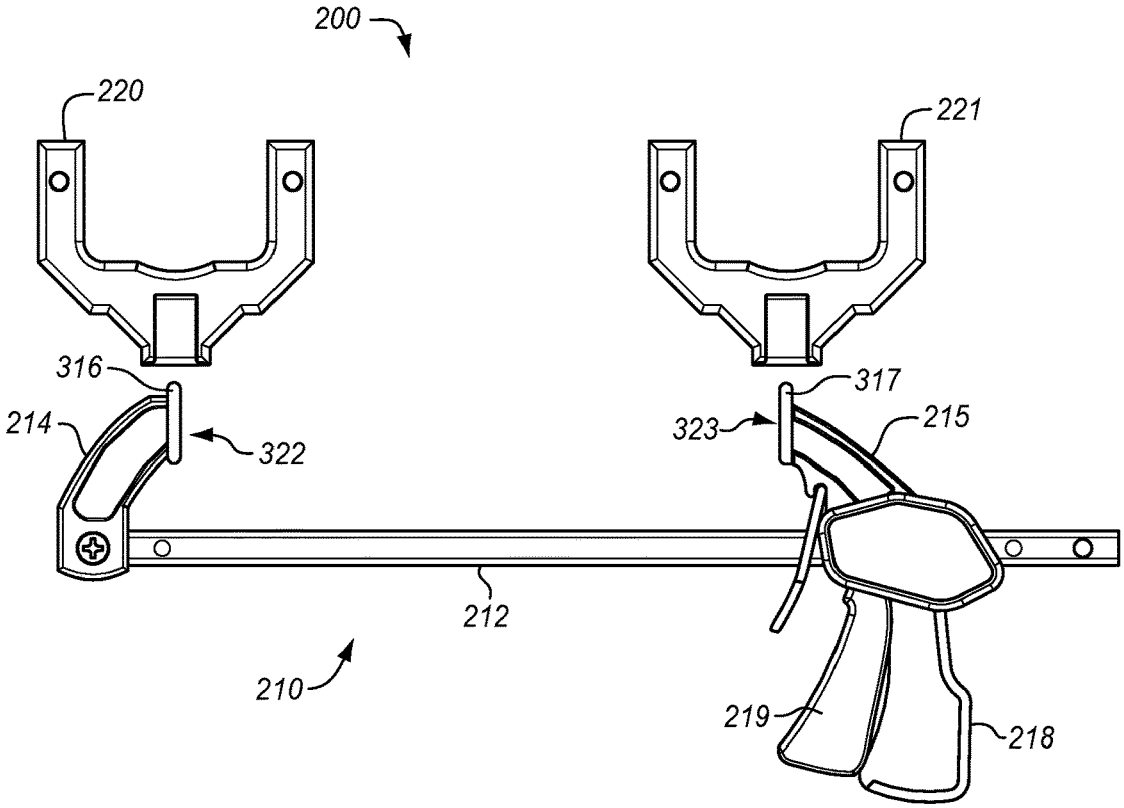

FIGS. 2-3 illustrate an electrical connector tool 200 in an illustrative embodiment. Electrical connector tool 200 is an apparatus or device configured to assist an operator in connecting electrical connectors. In FIG. 2, electrical connector tool 200 includes a bar clamp 210 and a pair of cradles 220-221. Bar clamp 210 includes a slide bar 212 and jaw members 214-215. In this embodiment, jaw member 214 is fixed to slide bar 212, and jaw member 215 is slidably or movably mounted to slide bar 212. Thus, the distance between jaw member 214 and jaw member 215 may be closed by movement of jaw member 215 along slide bar 212.

Bar clamp 210 is a ratcheting type in this embodiment. Jaw member 215 is affixed to a ratcheting handle 218 having a ratcheting mechanism (not shown) activated by a trigger 219. Squeezing of trigger 219 causes longitudinal translation of ratcheting handle 218/jaw member 215 along slide bar 212 in the direction of jaw member 214. Although a ratcheting bar clamp 210 is shown in FIG. 2, other types of bar clamps may be used which have one or more jaw members that slide toward one another along a slide bar.

Cradles 220-221 are configured to mount on jaw members 214-215. Cradles 220-221 each have a U-shape to receive and straddle an electrical connector 120/140. Cradles 220-221 are opposing as mounted on bar clamp 210. In other words, cradles 220-221 are aligned in the longitudinal direction of bar clamp 210, and are rotated 180 degrees in relation to each other so that the "front sides" of cradles 220-221 face each other. As will be described in more detail below, the front sides of cradles 220-221 will contact flanges on a pair of electrical connectors to squeeze the electrical connectors between cradles 220-221.

In one embodiment, cradles 220-221 may be permanently affixed or formed on jaw members 214-215. In another embodiment, cradles 220-221 may be temporarily or removably mounted on jaw members 214-215 as an accessory, such as shown in FIG. 3. FIG. 3 illustrates electrical connector tool 200 with cradles 220-221 removed from bar clamp 210. Jaw members 214-215 include jaw pads 316-317, respectively. A jaw pad 316-317 is the part of a jaw member 214-215 that contacts a workpiece during a normal clamping function, and applies a force via a pressing face 322-323. Jaw pads 316-317 may be made from a softer material than jaw members 214-215 to avoid indenting or marring the surface of a workpiece. Cradles 220-221 are configured to slide onto jaw pads 316-317, respectively, as shown in FIG. 2. When mounted in this manner, cradles 220-221 are aligned and face each other.

Figure 4:
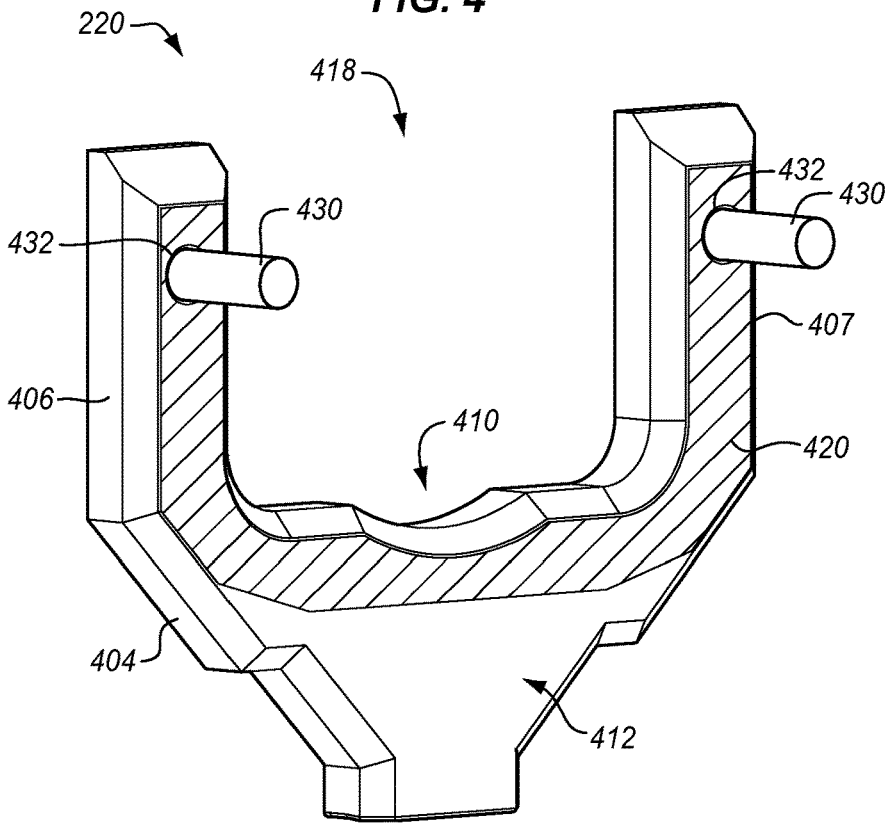
FIG. 4 is a perspective view of a cradle in an illustrative embodiment.

The following describes the structure of cradles 220-221. Although the description refers to cradle 220, cradle 221 may have a similar structure. FIG. 4 is a perspective view of cradle 220 in an illustrative embodiment. Cradle 220 may be a unibody or multi-piece member formed from a rigid material, such as plastic, a fiber-reinforced thermoplastic, or another type of material. The structure of cradle 220 includes a main body member 404 and arms 406-407. When oriented vertically as shown in FIG. 4, arms 406-407 project from a top side 410 of main body member 404 in parallel and are separated by a gap 418. The structure of cradle 220 may be referred to as a U-shape, as arms 406-407 and the top side 410 of main body member 404 form a "U".

The view in FIG. 4 is of a front side 412 of cradle 220. Front side 412 of cradle 220 (and consequently, the front side of main body member 404 and arms 406-407) is the side that faces cradle 221 when both are attached to bar clamp 210 as in FIG. 2. Front side 412 includes a contact surface 420 configured to abut or contact a flange 132/152 on an electrical connector 120/140, and apply a longitudinal force against flange 132/152. Contact surface 420 is formed by the surfaces of arms 406-407, and at least a portion of a surface of main body member 404. Contact surface 420 may be a substantially planar surface, and thus, arms 406-407 are coplanar along contact surface 420.

Cradle 220 may also include one or more index pins 430 that project from contact surface 420. Index pins 430 may project substantially perpendicular to contact surface 420 as shown in FIG. 4, or may project at a desired angle from contact surface 420. Index pins 430 may be cylindrical, may be cone-shaped, or may have another shape. In one embodiment, index pins 430 may be integral with arms 406-407 (i.e., formed in the same fabrication process). In another embodiment, index pins 430 may be affixed to arms 406-407 in a separate fabrication process. For example, holes 432 may be formed in arms 406-407, and index pins 430 may be pressed or otherwise fit into holes 432. Index pins 430 may be made from the same material as arms 406-407, or a different material. For example, arms 406-407 may be made from a plastic material while index pins 430 may be made from a metal.

Figure 5:
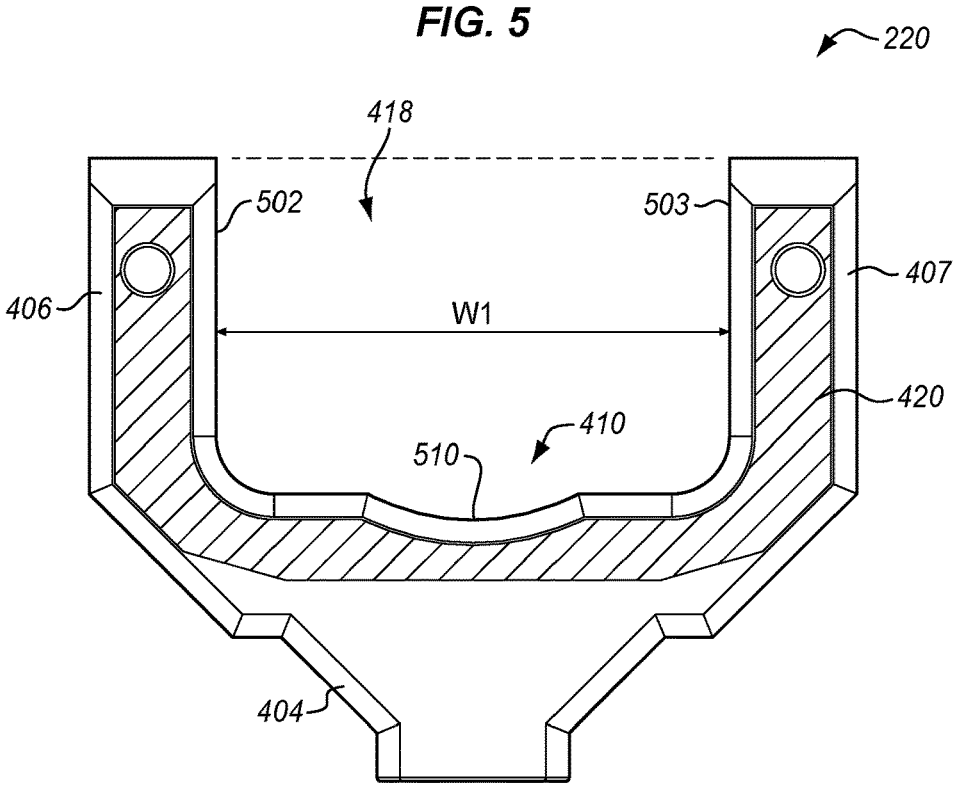
FIG. 5 illustrates a front side of a cradle in an illustrative embodiment.

FIG. 5 illustrates front side 412 of cradle 220 in an illustrative embodiment. The width (W1) of gap 418 is defined by the separation between an inner surface 502 of arm 406 and an inner surface 503 of arm 407. The width of gap 418 is dimensioned to accommodate an electrical connector. For instance, a typical electrical connector (i.e., electrical connector 120/140 in FIG. 1) has an elongated handle with a cylindrical or substantially cylindrical outer surface. The handle of the electrical connector may be inserted between arms 406-407 of cradle 220 so that arms 406-407 straddle the handle. Gap 418 may be dimensioned to be slightly larger than the outer surface of the handle so that the handle fits between arms 406-407. When a handle is inserted between arms 406-407, a portion of the outer surface of the handle may contact an upper surface 510 of main body member 404. Thus, a portion of upper surface 510 may be curved as shown in FIG. 5 or otherwise shaped to correspond with the contour of the handle.

Figure 6:
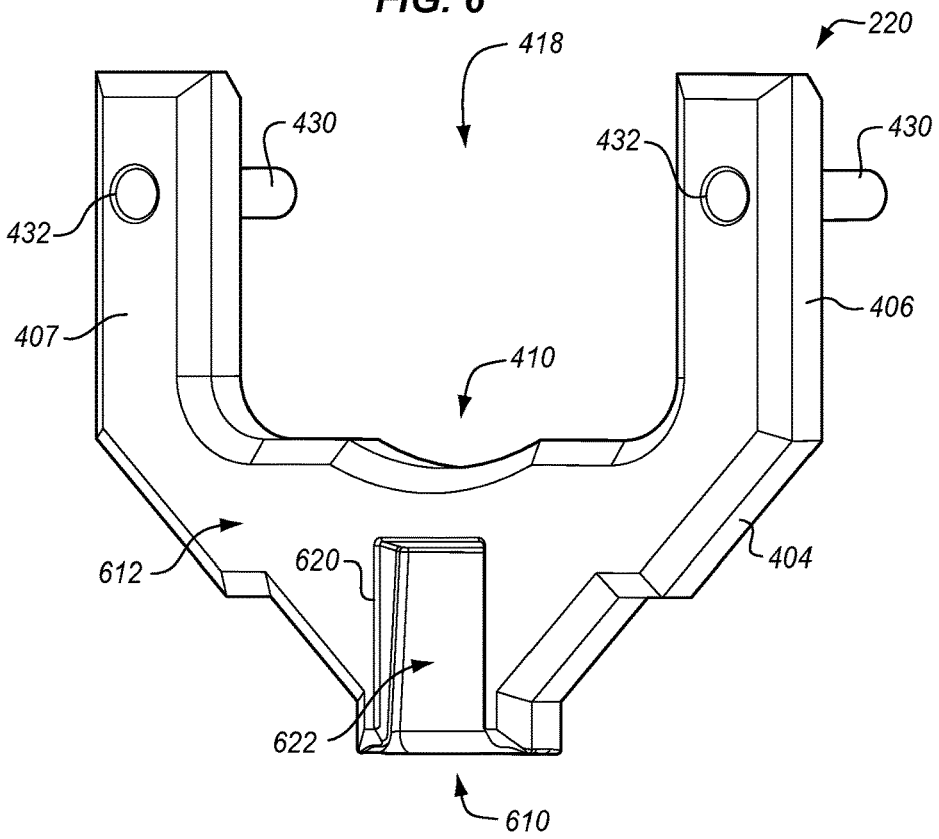
FIG. 6 is another perspective view of a cradle in an illustrative embodiment.

FIG. 6 is another perspective view of cradle 220 in an illustrative embodiment. FIG. 6 shows a back side 612 of cradle 220. Cradle 220 includes a jaw mount 620 that is configured to mount on or attach to a jaw member/jaw pad of a bar clamp, such as bar clamp 210. Jaw mount 620 is configured to mount cradle 220 on a jaw member/jaw pad of a bar clamp in an up-right orientation so that the lengthwise axes of arms 406-407 are transverse to the longitudinal direction of the bar clamp. In one embodiment, jaw mount 620 comprises a mounting slot or T-slot 622, which is a T-shape aperture in main body member 404 configured to receive a T-shaped feature on a bar clamp, such as a jaw member/jaw pad. Along its length, T-slot 622 extends from a bottom side 610 of cradle 220/main body member 404 toward top side 410 of main body member 404 so that T-slot 622 may receive a T-shaped feature from the bottom side 610 of cradle 220. T-slot 622, along its length, is substantially centered in main body member 404 between lengthwise axes of arms 406-407. The depth of T-slot 622 is from back side 612 of main body member 404, and into an interior of main body member 404.

Figure 7:
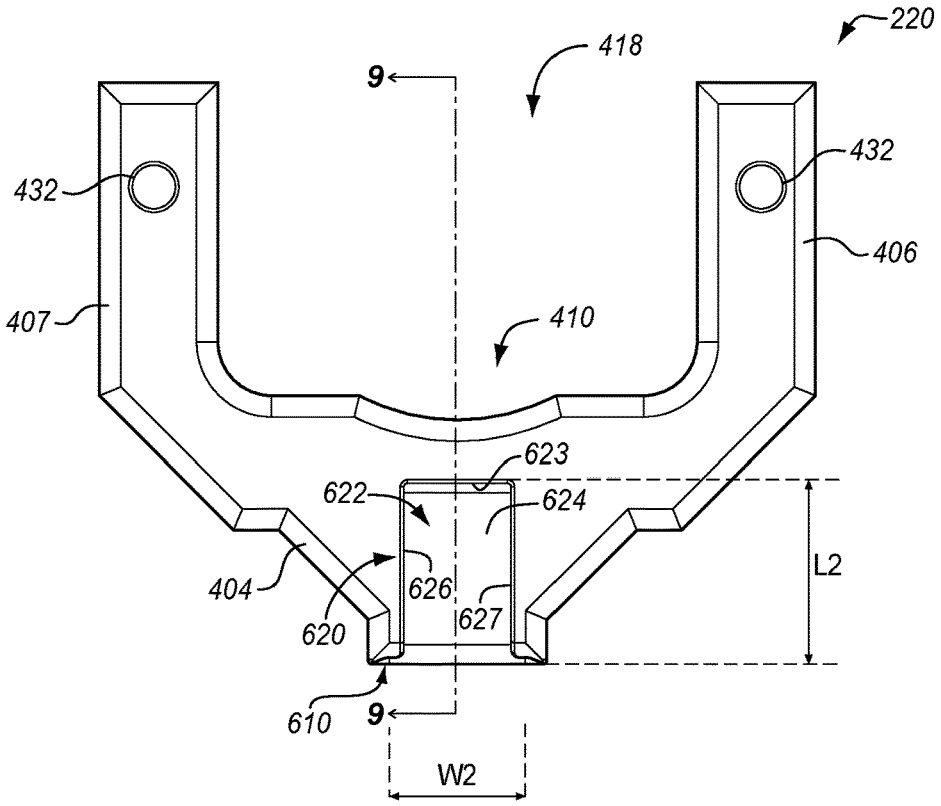
FIG. 7 illustrates a back side of a cradle in an illustrative embodiment.
Figure 8:
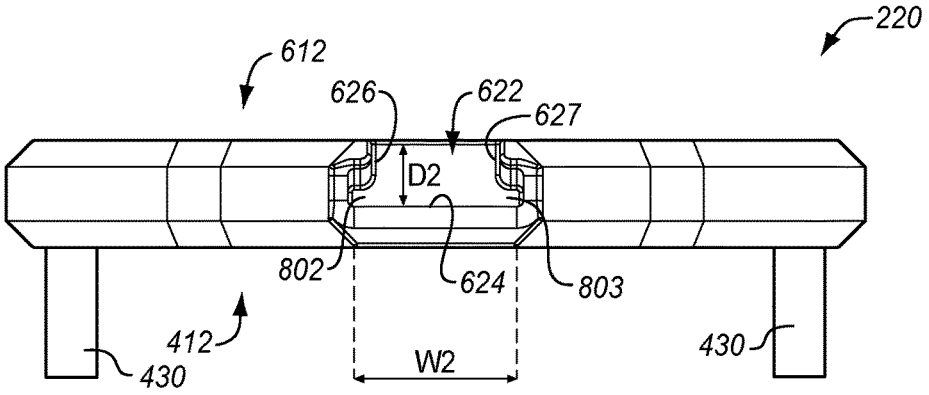
FIG. 8 illustrates a bottom side of a cradle in an illustrative embodiment.
Figure 9:
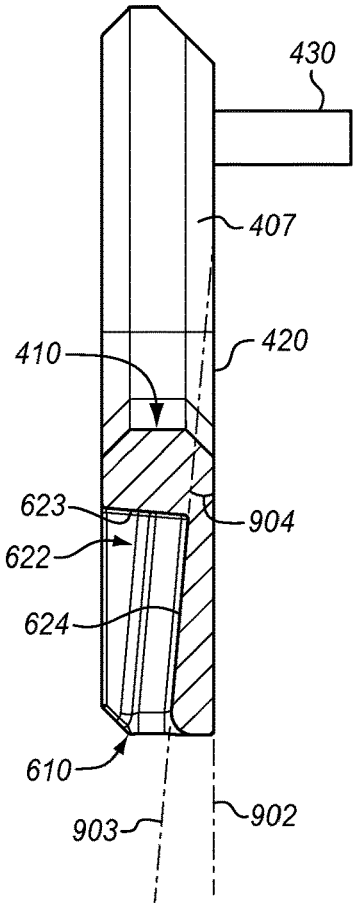
FIG. 9 is a cross-sectional view of a cradle in an illustrative embodiment.

FIGS. 7-9 further illustrate the configuration of T-slot 622. FIG. 7 illustrates back side 612 of cradle 220. The bottom, interior surface of T-slot 622 is referred to as base surface 624. Base surface 624 may comprise a substantially flat or planar surface configured to abut a pressing face 322-323 of a jaw pad 316-317, which is described in more detail below. T-slot 622 also has a top surface 623 and opposing side surfaces 626-627. The length (L2) of T-slot 622 is a distance between bottom side 610 of cradle 220/main body member 404 and top surface 623. The width (W2) of T-slot 622 is the maximum distance between side surfaces 626-627.

FIG. 8 illustrates bottom side 610 of cradle 220 in an illustrative embodiment. This figure illustrates the T-shaped design of T-slot 622. The width (W2) of T-slot 622 is wider in the interior of main body member 404 than at back side 612. Thus, the distance between side surfaces 626-627 is wider proximate to base surface 624, and narrows proximate to back side 612. The narrowing of side surfaces 626-627 defines opposing grooves 802-803 of T-slot 622 that are sized for a jaw pad 316-317. A jaw pad 316-317 may therefore be slid into grooves 802-803, and interlock with grooves 802-803 to secure cradle 220 onto a jaw member 214-215. When a jaw pad 316-317 is inserted in T-slot 622, the top side of the jaw pad 316-317 contacts top surface 623. The length (L2) of T-slot 622 therefore defines how far a cradle 220 can slide onto a jaw pad 316-317. Base surface 624 is defined by the depth (D2) of T-slot 622 in reference to back side 612. Base surface 624 abuts or contacts the pressing face 322-323 of the jaw pad 316-317 so that a force from pressing face 322-323 is applied to base surface 624. T-slot 622 may be open at back side 612 to accommodate the shape of a jaw member 214-215. The dimensions (e.g., length, width, and depth), shape, size, etc., of T-slot 622 may vary depending on the dimensions of the jaw member or jaw pad upon which cradle 220 is mounted.

FIG. 9 is a cross-sectional view of cradle 220 in an illustrative embodiment. The view in FIG. 9 is across view arrows 9-9 in FIG. 7. In this embodiment, base surface 624 is angled in relation to contact surface 420. Line 902 represents the plane of contact surface 420, and line 903 represents the plane of base surface 624. There is an angle 904 between contact surface 420 and base surface 624 in the range of 3-7 degrees. The angle 904 between contact surface 420 and base surface 624 acts to tip cradle 220 slightly backwards on a jaw member or jaw pad.

Referring to FIGS. 2-3, cradle 220 may be mounted on jaw member 214 by inserting jaw pad 316 into T-slot 622. Because jaw pad 316 and jaw member 214 have a T-shape, jaw pad 316 is able to slide into T-slot 622 until the top of jaw pad 316 contacts top surface 623. When inserted, pressing face 322 of jaw pad 316 contacts base surface 624 of T-slot 622. The sides of jaw pad 316 are positioned in grooves 802-803 of T-slot 622 to interlock jaw pad 316 with T-slot 622 in a slidable manner. Thus, although cradle 220 may be slid on and off jaw pad 316 in one direction, it is substantially secured on jaw pad 316 in the longitudinal direction of bar clamp 210 when jaw pad 316 is inserted in T-slot 622. In other words, a longitudinal force from jaw pad 316 is translated to cradle 220 without detaching cradle 220 from jaw pad 316. Cradle 221 may be mounted on jaw member 215 in a similar manner.

Figure 10:
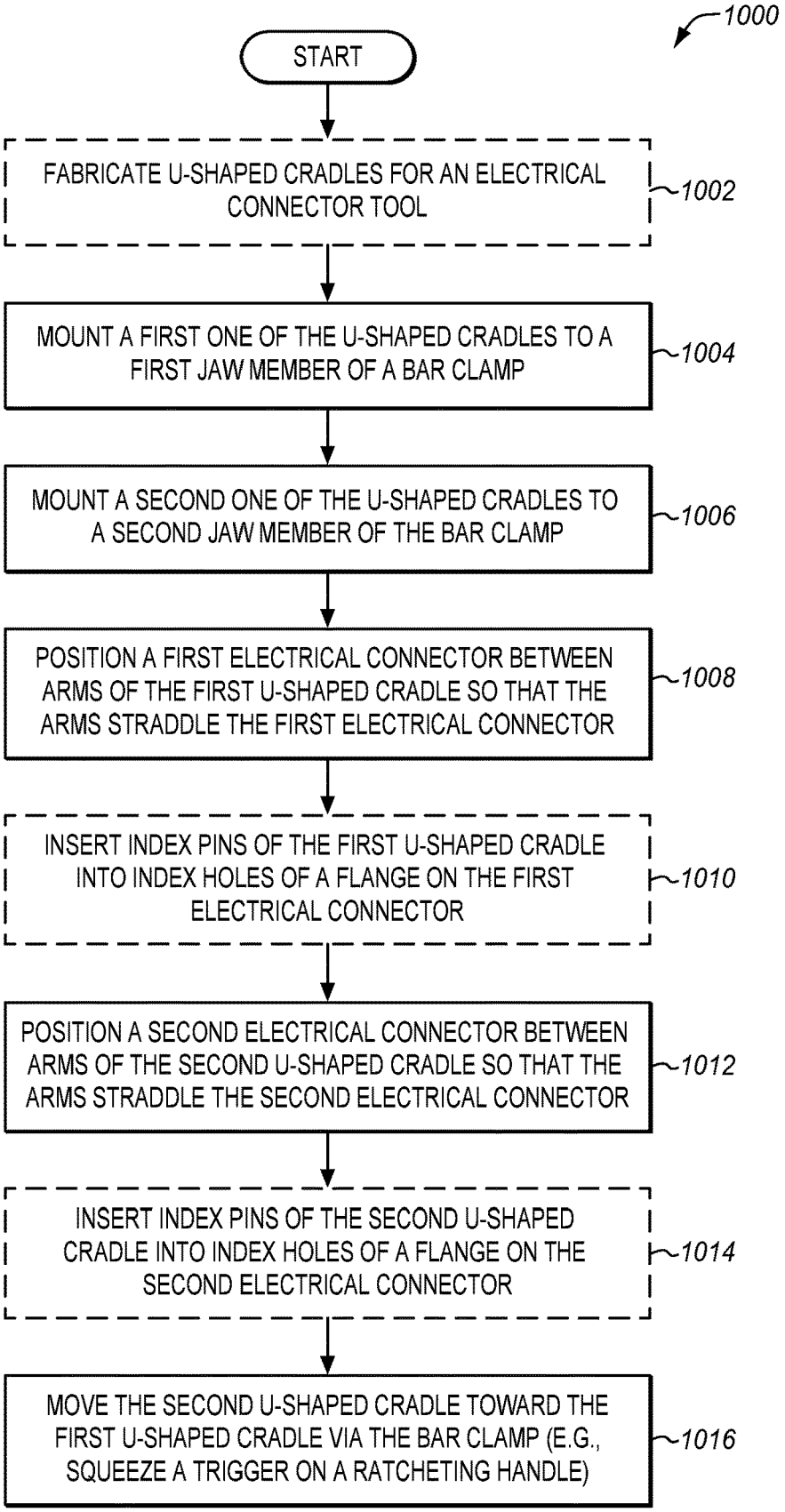
FIG. 10 is a flow chart illustrating a method of operating an electrical connector tool in an illustrative embodiment.

FIG. 10 is a flow chart illustrating a method 1000 of operating electrical connector tool 200 in an illustrative embodiment. The steps of method 1000 will be described with reference to electrical connector tool 200 in FIGS. 2-9, but those skilled in the art will appreciate that method 1000 may be performed with other tools. Also, the steps of the flow charts described herein are not all inclusive and may include other steps not shown, and the steps may be performed in an alternative order.

Method 1000 begins with the optional step of fabricating, manufacturing, or otherwise forming cradles 220-221 for electrical connector tool 200 (step 1002). An operator or other user may create or identify a Computer-Aided Design (CAD) model of the cradles 220-221. The CAD model may be parametric so that the operator may set the width of gap 418 based on the size of the electrical connector, set the dimensions/shape of T-slot 622 based on the dimensions/shape of a jaw member/jaw pad on a bar clamp, etc. The operator may then fabricate the cradles 220-221 based on the CAD model, such as with 3D printing.

After forming or otherwise acquiring the cradles 220-221, the operator installs, mounts, or otherwise attaches one of the cradles 220 on one of the jaw members of a bar clamp (step 1004), such as fixed jaw member 214. To mount cradle 220, the operator may insert jaw pad 316 into T-slot 622 of cradle 220. When jaw pad 316 is fully inserted into T-slot 622, cradle 220 is substantially secured on fixed jaw member 214. The operator also installs, mounts, or otherwise attaches the other one of the cradles 221 on the other one of the jaw members of the bar clamp (step 1006), such as moveable jaw member 215. To mount cradle 221, the operator may insert jaw pad 317 into T-slot 622 of cradle 221. When jaw pad 317 is fully inserted into T-slot 622, cradle 221 is substantially secured on moveable jaw member 215. When installed in this manner, contact surface 420 of cradle 220 faces contact surface 420 of cradle 221 (see FIG. 2). The operator may separate cradles 220-221 on bar clamp 210 a desired distance for the following steps.

Figure 11:
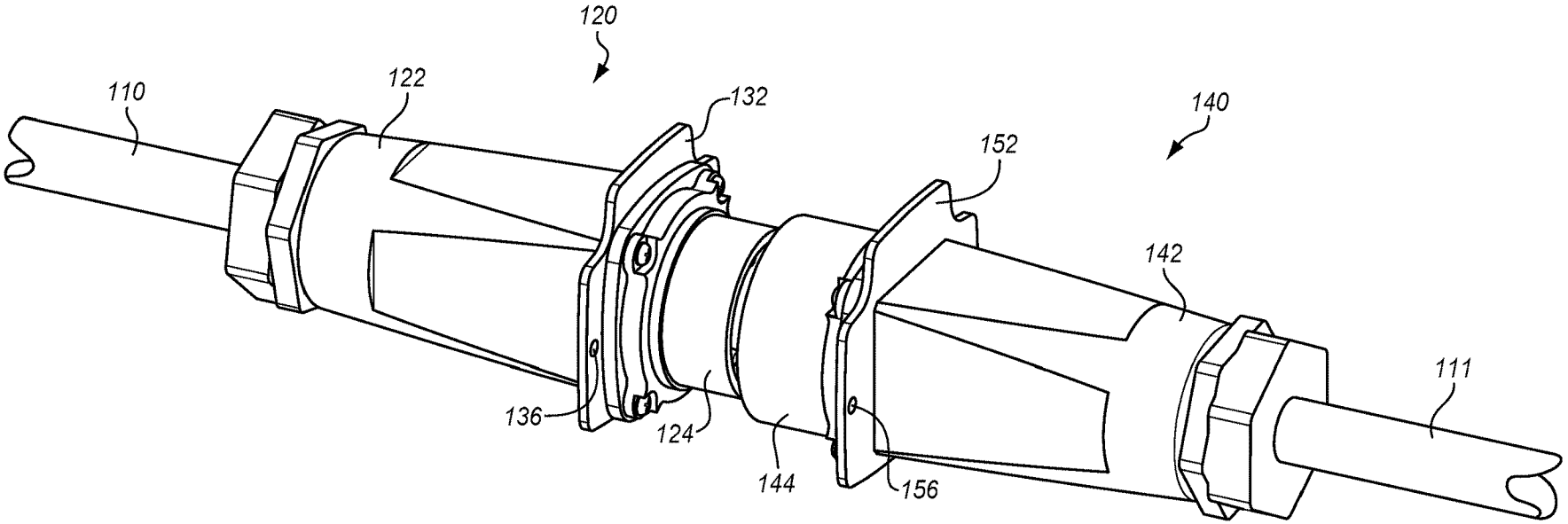
FIG. 11 illustrates one electrical connector aligned with another electrical connector in an illustrative embodiment.
Figure 12:
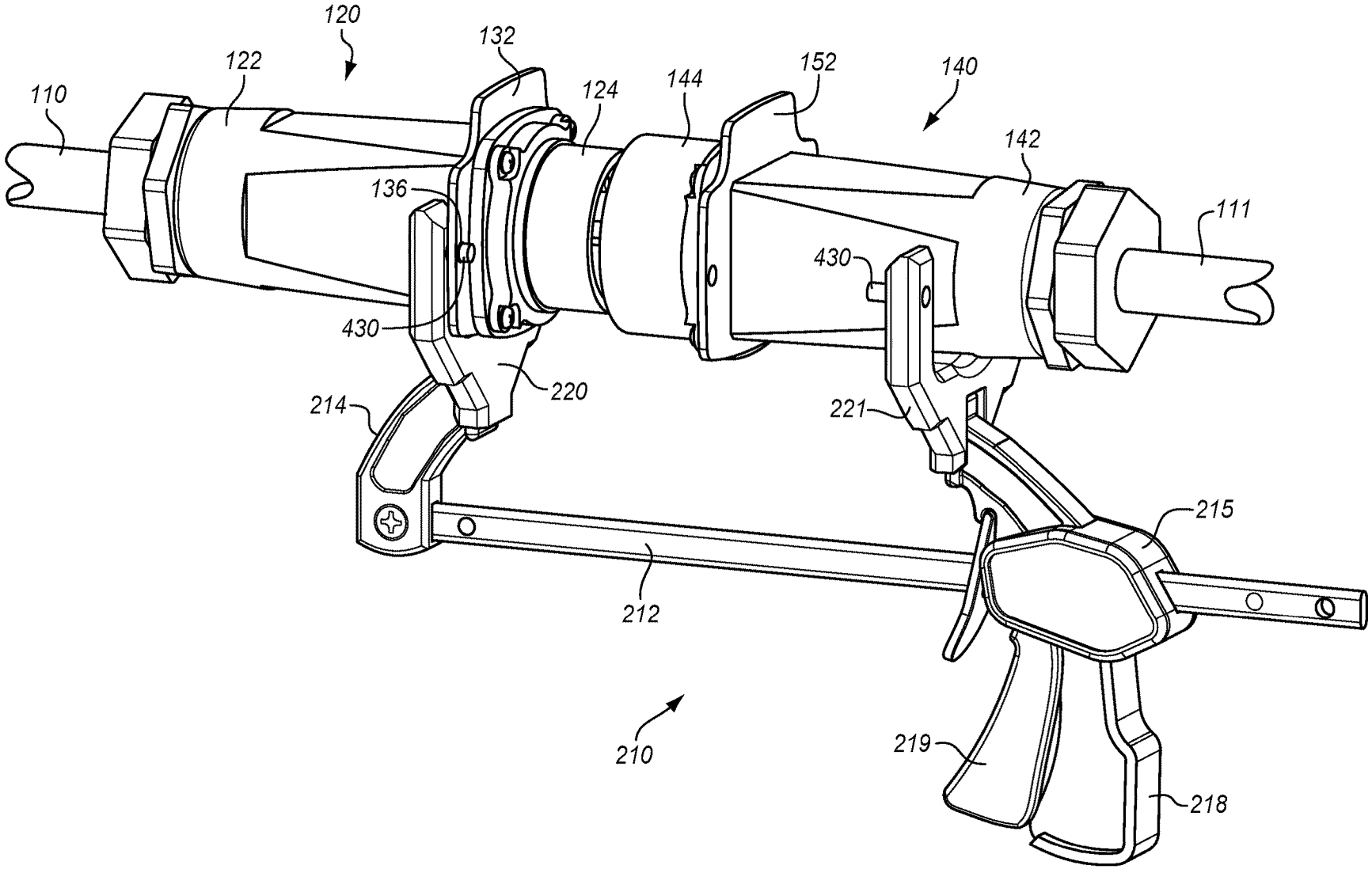
FIG. 12 illustrates an electrical connector placed in a cradle in an illustrative embodiment.

One assumption at this point is that the operator is tasked with connecting two electrical connectors 120/140 (see FIG. 1). To begin, the operator may align plug 124 of electrical connector 120 with receptacle 144 of electrical connector 140, and insert plug 124 into receptacle 144 a limited amount as shown in FIG. 11. The operator positions electrical connector 120 in cradle 220 (step 1008). More particularly, the operator places electrical connector 120 lengthwise between arms 406-407 of cradle 220 so that arms 406-407 straddle electrical connector 120 as shown in FIG. 12. With arms 406-407 straddling electrical connector 120, the contact surface 420 of cradle 220 (see FIG. 4) may be brought into contact with the flange 132 (e.g., draw plate) of electrical connector 120. Contact surface 420 will contact a side of flange 132 that is facing electrical cord 110, and that is opposite the side facing plug 124. The operator may optionally insert index pins 430 of cradle 220 into index holes 136 of flange 132 (step 1010).

Figure 13:
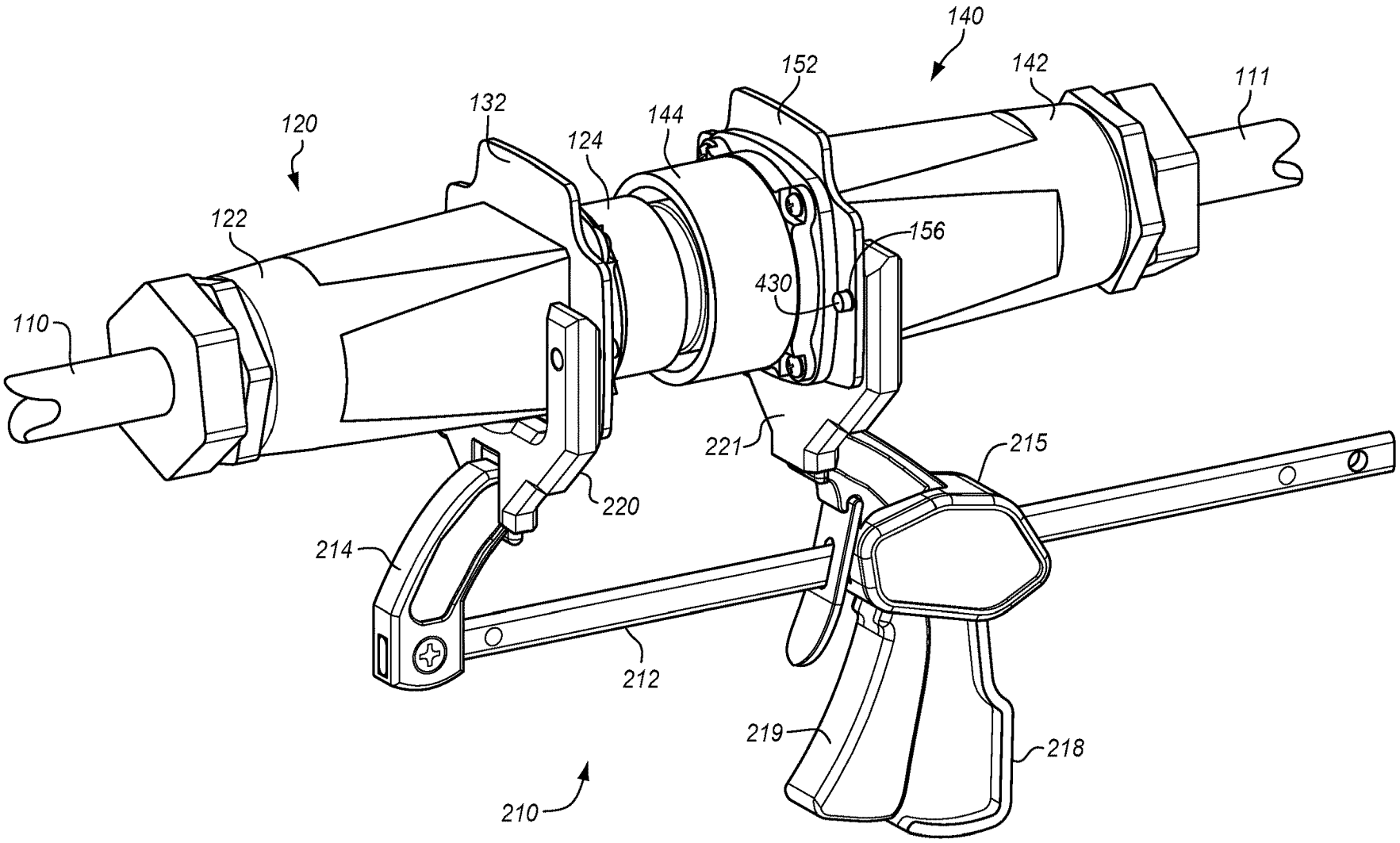
FIG. 13 illustrates another electrical connector placed in another cradle in an illustrative embodiment.

The operator positions the other electrical connector 140 in cradle 221 (step 1012). More particularly, the operator places the electrical connector 140 lengthwise between arms 406-407 of cradle 221 so that arms 406-407 straddle the electrical connector 140 as shown in FIG. 13. With arms 406-407 straddling the electrical connector 140, the contact surface 420 of cradle 221 (see FIG. 4) may be brought into contact with the flange 152 (e.g., draw plate) of electrical connector 140. Contact surface 420 will contact a side of flange 152 that is facing electrical cord 111, and that is opposite the side facing receptacle 144. The operator may optionally insert index pins 430 of cradle 221 into index holes 156 of flange 152 (step 1014).

Figure 14:
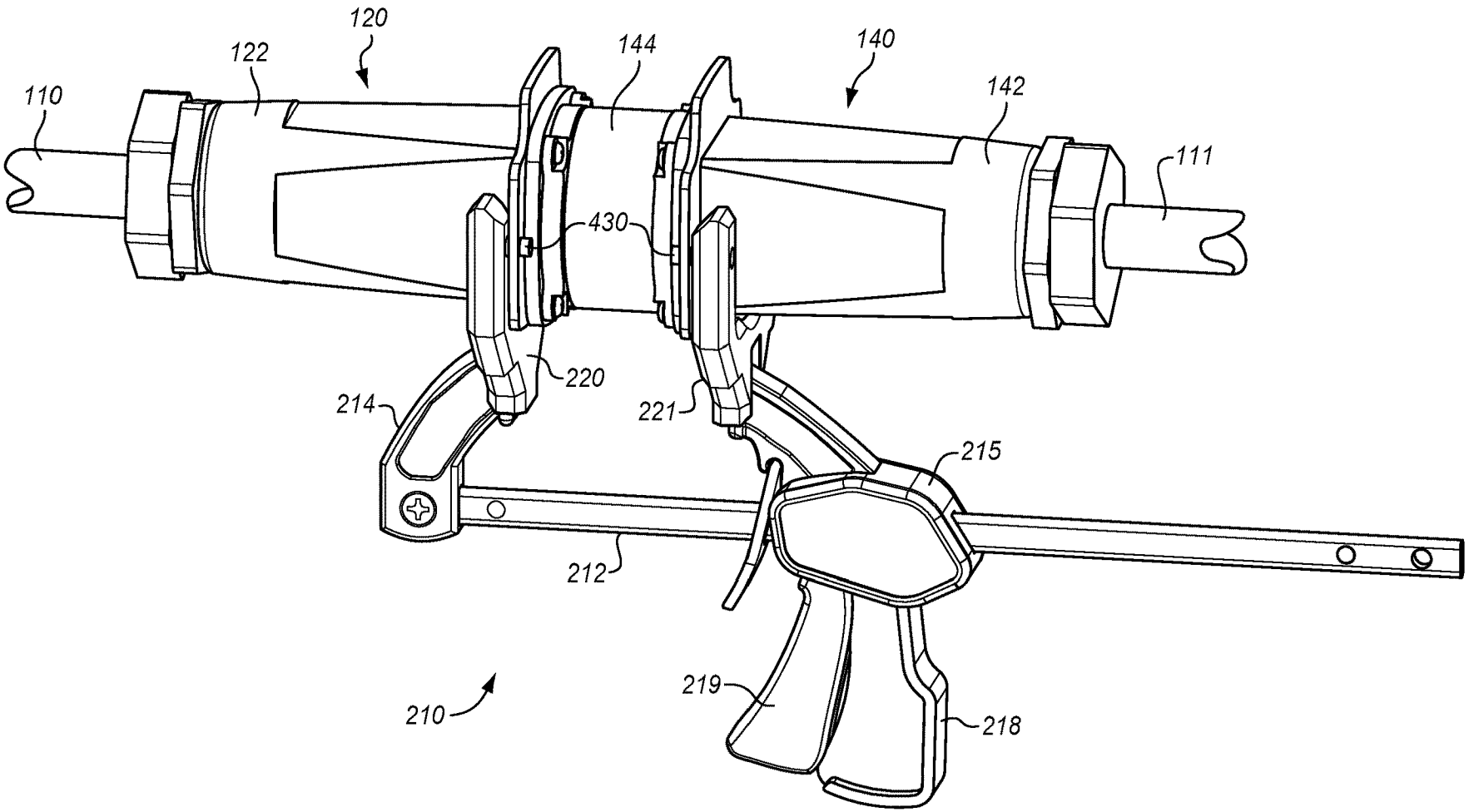
FIG. 14 illustrates an electrical connector tool squeezing electrical connectors to complete an electrical connection in an illustrative embodiment.

As evident in FIG. 13, electrical connectors 120/140 are sandwiched between cradles 220-221. The operator then moves cradle 221 toward cradle 220 via bar clamp 210 (step 1016) as shown in FIG. 14. As cradle 221 is drawn toward cradle 220, they force electrical connectors 120/140 together to make a full connection (i.e., plug 124 is fully inserted in receptacle 144). For instance, when bar clamp 210 is a ratcheting-type clamp as in FIG. 2, the operator may repeatedly squeeze the trigger 219 on ratcheting handle 218 to longitudinally translate cradle 221 along slide bar 212 toward cradle 220. Contact surface 420 of cradle 220 exerts a force against flange 132 on electrical connector 120 in the direction of electrical connector 140 simultaneously as contact surface 420 of cradle 221 exerts a force against flange 152 on electrical connector 140 in the direction of electrical connector 120. These opposing forces compress electrical connectors 120/140 together to fully insert plug 124 into receptacle 144. The angle of cradles 220-221 on jaw members 214-215 and index pins 430 maintain the alignment of plug 124 and receptacle 144 as they are pressed together to avoid binding.

Electrical connector tool 200 advantageously allows the operator to use one hand to couple electrical connectors 120/140, instead of having to grasp electrical connectors 120/140 with both hands and trying to insert plug 124 into receptacle 144. The amount of exertion by the operator in squeezing trigger 219 on ratcheting handle 218 is much less than what is required to manually insert plug 124 into receptacle 144. Thus, operators will experience less muscle fatigue throughout the workday. And, operators with weaker hand/arm muscles or operators with one hand may effectively couple electrical connectors 120/140 using electrical connector tool 200.

Although specific embodiments were described herein, the scope is not limited to those specific embodiments. Rather, the scope is defined by the following claims and any equivalents thereof.

What is claimed is:

1. An apparatus comprising:
a first U-shaped cradle; and
a second U-shaped cradle;
wherein the first U-shaped cradle and the second U-shaped cradle are configured to mount on a bar clamp having a slide bar and jaw members with at least one of the jaw members slidably mounted on the slide bar;
wherein each of the first U-shaped cradle and the second U-shaped cradle comprises:
a main body member;
arms that project from a top side of the main body member and are spaced apart by a gap to form a U-shape;
a contact surface on a front side of the arms configured to contact a flange on an electrical connector; and
a jaw mount in the main body member configured to mount on one of the jaw members of the bar clamp;
wherein when mounted on the bar clamp, the contact surface of the first U-shaped cradle faces the contact surface of the second U-shaped cradle.

2. The apparatus of claim 1 wherein:
the first U-shaped cradle and the second U-shaped cradle are configured to removably mount on the jaw members of the bar clamp.

3. The apparatus of claim 1 wherein:
the arms project in parallel from the top side of the main body member.

4. The apparatus of claim 1 wherein:
the gap between the arms is dimensioned so that an outer surface of the electrical connector fits between the arms.

5. The apparatus of claim 1 wherein:
the jaw mount comprises a T-slot formed in the main body member that extends from a bottom side of the main body member toward the top side of the main body member.

6. The apparatus of claim 5 wherein:
the T-slot includes a base surface disposed at a depth from a back side of the main body member; and
the base surface is oriented at an angle to the contact surface.

7. The apparatus of claim 6 wherein:
the base surface slants from the bottom side of the main body member toward the contact surface at an angle in the range of 3-7 degrees.

8. The apparatus of claim 6 wherein:
the T-slot is dimensioned to receive a jaw pad on the one of the jaw members with the base surface abutting a pressing face of the jaw pad.

9. The apparatus of claim 1 wherein each of the first U-shaped cradle and the second U-shaped cradle comprises:
at least one index pin in at least one of the arms that projects from the contact surface.

10. The apparatus of claim 9 wherein the at least one index pin projects perpendicularly from the contact surface.

11. A method of operating an electrical connector tool comprising a first U-shaped cradle, a second U-shaped cradle, and a bar clamp, wherein the bar clamp includes a slide bar and jaw members with at least one of the jaw members slidably mounted on the slide bar, and wherein each of the first U-shaped cradle and the second U-shaped cradle includes a main body member, arms that project from a top side of the main body member and are spaced apart by a gap to form a U-shape, a contact surface on a front side of the arms configured to contact a flange on an electrical connector, and a jaw mount in the main body member configured to mount on one of the jaw members of the bar clamp, the method comprising:
mounting the first U-shaped cradle to a first jaw member of the bar clamp;
mounting the second U-shaped cradle to a second jaw member of the bar clamp so that the contact surface of the first U-shaped cradle faces the contact surface of the second U-shaped cradle;
positioning a first electrical connector in the first U-shaped cradle so that the contact surface of the first U-shaped cradle contacts a first flange on the first electrical connector;
positioning a second electrical connector in the second U-shaped cradle so that the contact surface of the second U-shaped cradle contacts a second flange on the second electrical connector; and
moving the second U-shaped cradle toward the first U-shaped cradle via the bar clamp to connect the second electrical connector with the first electrical connector.

12. The method of claim 11 further comprising:

inserting at least one index pin that projects from the contact surface of the first U-shaped cradle through at least one index hole in the first flange on the first electrical connector; and inserting at least one index pin that projects from the contact surface of the second U-shaped cradle through at least one index hole in the second flange on the second electrical connector.

13. The method of claim 11 wherein:

the bar clamp comprises a ratcheting bar clamp; and moving the second U-shaped cradle toward the first U-shaped cradle comprises squeezing a trigger on a ratcheting handle of the ratcheting bar clamp.

14. The method of claim 11 further comprising:

fabricating the first U-shaped cradle and the second U-shaped cradle via 3D printing.

15. An electrical connector tool comprising:

a bar clamp including a fixed jaw member fixedly attached to a slide bar, and a movable jaw member movably attached to the slide bar;

a first U-shaped cradle having a first main body member, first arms that project from a top side of the first main body member and are spaced apart by a gap to form a U-shape, a contact surface on a front side of the first arms configured to contact a flange on a first electrical connector when the first electrical connector is positioned in the first U-shaped cradle, and a first jaw mount in the first main body member configured to mount on the fixed jaw member; and a second U-shaped cradle having a second main body member, second arms that project from a top side of the second main body member and are spaced apart by a gap to form a U-shape, a contact surface on a front side of the second arms configured to contact a flange on a second electrical connector when the second electrical connector is positioned in the second U-shaped cradle, and a second jaw mount in the second main body member configured to mount on the movable jaw member;

wherein the first U-shaped cradle and the second U-shaped cradle are mounted on the fixed jaw member and the movable jaw member respectively with the contact surface of the first U-shaped cradle facing the contact surface of the second U-shaped cradle;

wherein the bar clamp further includes a ratcheting handle configured to move the movable jaw member toward the fixed jaw member to compress the first electrical connector and the second electrical connector between the first U-shaped cradle and the second U-shaped cradle.

16. The electrical connector tool of claim 15 wherein:

the first U-shaped cradle includes at least one index pin that projects from the contact surface of the first U-shaped cradle, and is configured to be inserted through at least one index hole in the flange on the first electrical connector; and the second U-shaped cradle includes at least one index pin that projects from the contact surface of the second U-shaped cradle, and is configured to be inserted through at least one index hole in the flange on the second electrical connector.

17. The electrical connector tool of claim 16 wherein:

the at least one index pin of the first U-shaped cradle and the at least one index pin of the second U-shaped cradle are cone shaped.

18. The electrical connector tool of claim 15 wherein:

the first U-shaped cradle and the second U-shaped cradle are removably mounted on the fixed jaw member and the movable jaw member respectively.

19. The electrical connector tool of claim 15 wherein each of the first main body member and the second main body member includes:

a T-slot that extends from a bottom side toward the top side;

wherein the T-slot is dimensioned to receive a jaw pad on the fixed jaw member or the moveable jaw member with a base surface abutting a pressing face of the jaw pad;

wherein the base surface of the T-slot is oriented at an angle to the contact surface.

20. The electrical connector tool of claim 19 wherein:

the base surface slants from the bottom side toward the contact surface at an angle in the range of 3-7 degrees.

* * * * *